US005263642A

United States Patent [19]

Orchard

[11] Patent Number: 5,263,642

[45] Date of Patent: Nov. 23, 1993

[54] APPARATUS FOR AUTOMATICALLY STARTING A PELLET FURNACE

[75] Inventor: Kenneth L. Orchard, Beaverton, Oreg.

[73] Assignee: Ortech Industries, Inc., Beaverton, Oreg.

[21] Appl. No.: 823,704

[22] Filed: Jan. 21, 1992

Related U.S. Application Data

[63] Continuation-in-part of Ser. No. 621,067, Nov. 29, 1990, abandoned.

[51] Int. Cl.[5] ..... F23N 5/18; F23N 5/00

[52] U.S. Cl. ..... 236/46 B; 110/188; 110/190; 431/74

[58] Field of Search ..... 110/185, 189, 190; 126/502; 431/74; 236/46 B

[56] References Cited

U.S. PATENT DOCUMENTS

| | | | |
|---|---|---|---|
| 2,237,237 | 4/1941 | Scoggin et al. | 110/190 |
| 2,738,742 | 3/1956 | Campbell | 110/190 |
| 3,068,812 | 12/1962 | Hemeon | 110/190 X |
| 4,797,776 | 1/1989 | Snyder | 110/190 X |

*Primary Examiner*—William E. Wayner
*Attorney, Agent, or Firm*—Smith-Hill and Bedell

[57] ABSTRACT

Apparatus for igniting a solid fuel furnace having a firebox and an electrically controllable fuel supply mechanism for feeding fuel to the firebox comprises an electrically controllable heating element for igniting fuel in the firebox. A control circuit is connected to the fuel supply mechanism and the heating element for energizing the fuel supply mechanism and the heating element for a predetermined activation time and for supplying power to the fuel supply mechanism after the activation time has expired.

26 Claims, 6 Drawing Sheets

APPARATUS FOR AUTOMATICALLY STARTING A PELLET FURNACE

CROSS REFERENCE TO RELATED APPLICATION

This is a continuation-in-part of co-pending patent application Ser. No. 07/621,067 filed Nov. 29, 1990, now abandoned.

BACKGROUND OF THE INVENTION

This invention relates to a pellet furnace, and more specifically to an apparatus for automatically starting a pellet furnace.

A wood pellet furnace generally comprises a firebox, a fuel storage hopper, and an electrically driven feed mechanism for feeding fuel from the hopper to the firebox. Such a furnace is used to supply heat to a living space in accordance with the setting of a room thermostat, which senses the temperature in the living space. When the room thermostat demands heat, the feed mechanism is energized and fuel is delivered to the firebox. The fuel is ignited by a pilot fire that is maintained in the firebox, and the heat output of the furnace increases. When the thermostat no longer demands heat, the feed mechanism is not continuously energized, but it is energized intermittently to sustain the pilot fire, and accordingly the heat output of the furnace is reduced.

It is usual to extinguish the pilot fire at the end of the heating season. A low limit cut-out switch, which senses the temperature in the firebox, is connected in series with the feed mechanism. As long as a fire is burning in the firebox, the temperature in the furnace will remain above the low limit switch preset level and the switch will remain conductive. When the fire is extinguished at the end of the heating season, the low level cut-out switch becomes non-conductive, preventing supply of current to the feed mechanism. This prevents fuel being supplied to the firebox when there is no fire and guards against possible overflow of the firebox. However, at the beginning of the heating season, when it is time to light the pilot fire, the low level cut-out switch makes it difficult to start the pilot fire, because fuel has to be manually loaded into the firebox and ignited by hand in order to start the pilot fire.

SUMMARY OF THE INVENTION

In accordance with a first aspect of the present invention, a control circuit for a solid fuel furnace having a firebox and electrically controllable fuel supply means for feeding fuel to the firebox comprises means for activating the fuel supply means for a preset amount of time, and means for supplying power to the fuel supply means after the activation time has expired.

In accordance with a second aspect of the present invention, apparatus for igniting a solid fuel furnace having a firebox and electrically controllable fuel supply means for feeding fuel to the firebox comprises an electrically controllable heating element for igniting fuel in the firebox, means adapted to be connected to the fuel supply means and the heating element for energizing the fuel supply means and the heating element for a predetermined activation time, and means for supplying power to the fuel supply means after the activation time has expired.

In accordance with a third aspect of the present invention, apparatus for igniting fuel in a solid fuel furnace having a firebox and electrically controllable fuel supply means for feeding fuel to the firebox comprises an electrically controllable heating element for igniting fuel in the firebox, the heating element being displaceable between a position inside the firebox and a position outside the firebox, means for displacing the heating element from its position outside the firebox to its position inside the firebox, means for activating the displacing means, the heating element and the fuel supply means for a predetermined activation time, and means for supplying power to the fuel supply means after the activation time has expired.

In accordance with a fourth aspect of the present invention, apparatus for igniting fuel in a solid fuel furnace having a firebox comprises an electrically controllable heating element for igniting fuel in the firebox, regulatable power supply means for energizing the heating element, and means for controlling the power supply means in accordance with the temperature in the firebox.

BRIEF DESCRIPTION OF THE DRAWINGS

For a better understanding of the invention, and to show how the same may be carried into effect, reference will now be made, by way of example, to the accompanying drawings in which.

In the different figures, like reference numerals designate corresponding components.

DETAILED DESCRIPTION

Figure 1:
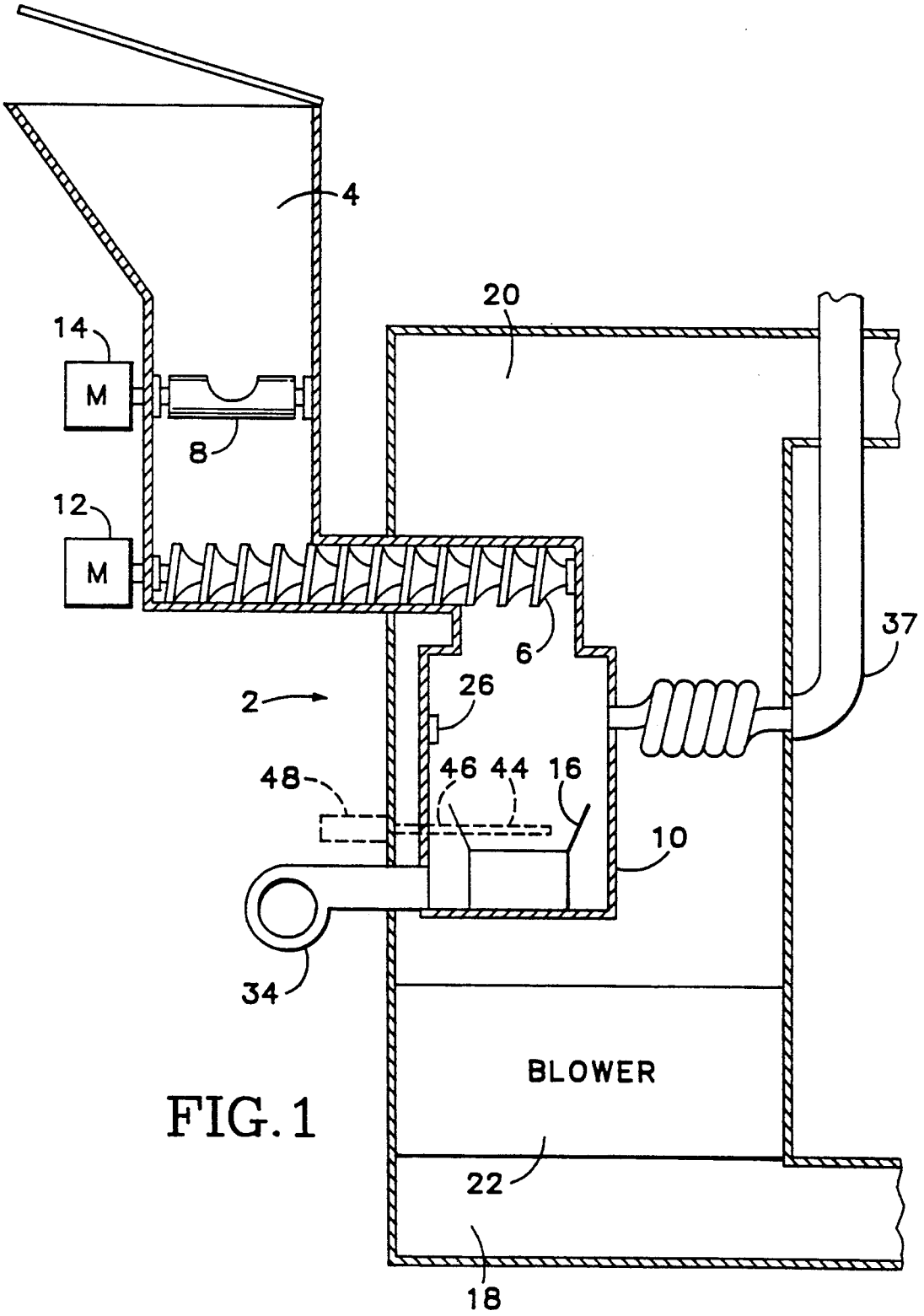
FIG. 1 is a diagram of a wood pellet furnace with an automated fuel feeder.

FIG. 1 illustrates in solid lines a wood pellet furnace 2 comprising a storage hopper 4 for holding wood pellets. Pellets are transferred from the storage hopper to an electrically driven auger 6 by an electrically driven cup 8 and are fed by the auger to a firebox 10. Auger 6 and cup 8 are powered by respective electric motors 12 and 14 whose control circuitry will be described below. Firebox 10 contains a firepot 16 to receive wood pellets dropped by auger 6. The pellets delivered to firebox 10 by auger 6 are burned in firepot 16, emitting heat. Firebox 10 is disposed in a plenum having an inlet chamber 18 and an outlet chamber 20. A blower 22 moves air from the inlet chamber past the firebox to outlet chamber 20. The air passing the firebox is heated and is then conducted to a living space where a room thermostat (not shown) is located.

Figure 2:
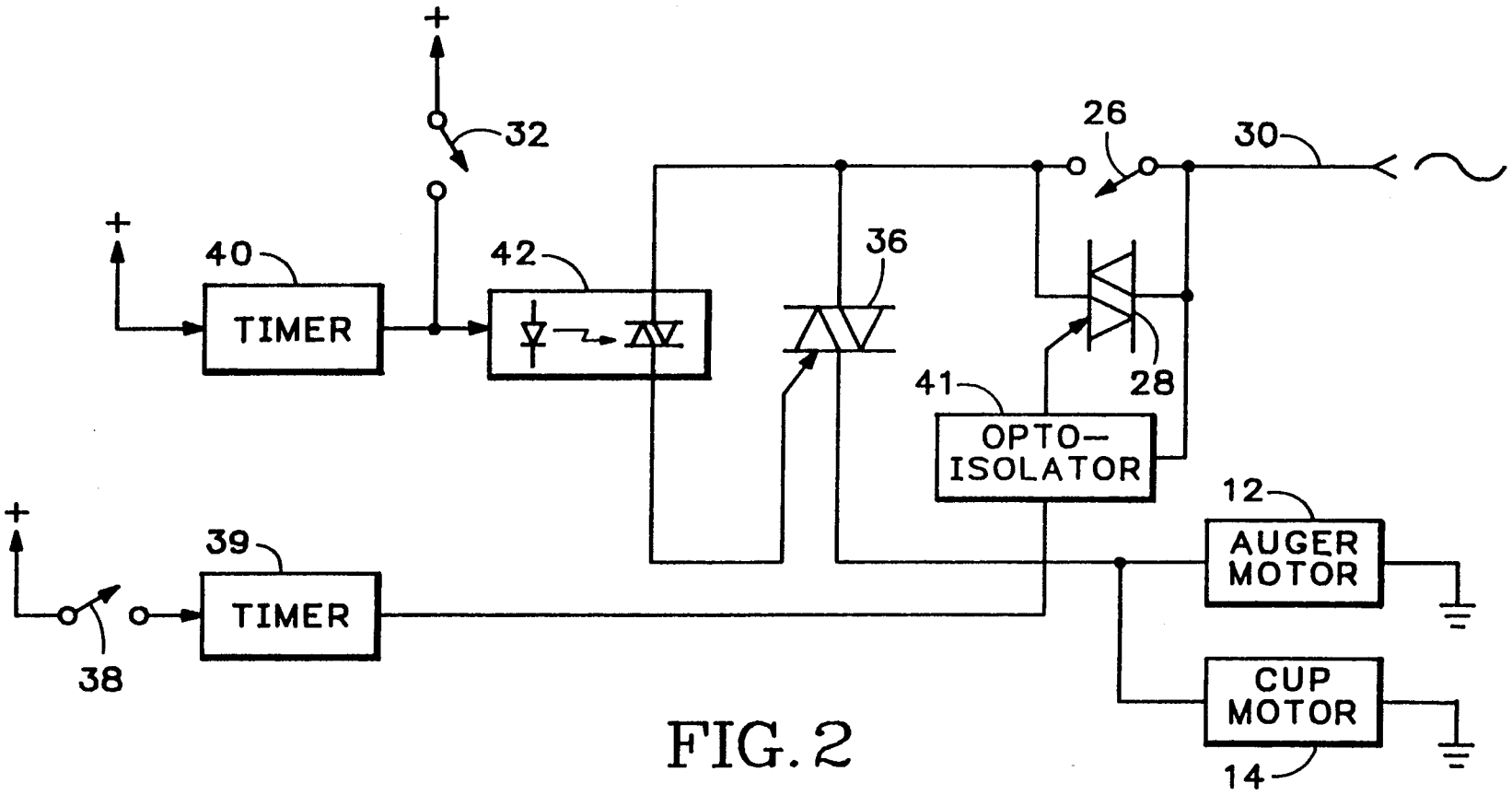
FIG. 2 is a circuit diagram for an electrical control system that automatically supplies fuel to a wood pellet furnace.

The control circuit for the FIG. 1 furnace is shown in FIG. 2. FIG. 2 illustrates a low limit switch 26 which is mounted in firebox 10 to detect when the temperature in the firebox passes a certain threshold value indicating that a fire exists in firebox 10. As shown in FIG. 2, auger motor 12 is connected in series with switch 26 and a triac 36 between a public utility supply line 30 and ground, and cup motor 14 is connected in parallel with auger motor 12. Triac 36 is controlled in response to the state of a room thermostat switch 32 or a timer 40 through an optoisolator 42. If the room thermostat demands heat, switch 32 is conductive. If switch 26 also is conductive, optoisolator 42 connects line 30 to the control electrode of triac 36, thus rendering triac 36 conductive. Motors 12 and 14 drive the auger 6 and the cup 8 continuously. Accordingly, wood pellets are delivered continuously to firebox 10 and are burned in the firepot, and the furnace provides a maximum heat output. When there is no longer a demand for heat, switch 32 becomes non-conductive. Timer 40 enters its conductive state intermittently, e.g. one minute out of five. Therefore, even when switch 32 is non-conductive, motors 12 and 14 drive auger 6 and cup 8 to supply wood pellets to firebox 10 at a sufficient rate to maintain a pilot fire. A draft inducer 34 (FIG. 1) supplies oxygen to the firebox to support combustion of the wood pellets. The draft inducer also helps remove combustion gases from the furnace by sending them out flue 37. Draft inducer 34 is driven only when the room thermostat demands heat.

A manually operable switch 38 is connected to activate a second timer 39. Timer 39 is connected through a second optoisolator 41 to the control electrode of a second triac 28, which is connected in parallel with switch 26. Normally, switch 38 is non-conductive, timer 39 is deactivated and triac 28 is non-conductive. When timer 39 is activated, it supplies an output signal to optoisolator 41. Optoisolator 41 is electrically connected to line 30 but nevertheless electrically isolates switch 38 from line 30. When optoisolator 41 receives the output signal from timer 39, it connects line 30 to the control electrode of triac 28, thus rendering triac 28 conductive.

To start the furnace at the beginning of the heating season, kindling is placed in firepot 16 and lit. The room thermostat is set so that it demands heat and accordingly switch 32 is conductive. When the kindling is burning, switch 38 is depressed, activating timer 39 for a preset amount of time. When the timer 39 is activated, optoisolator 41 enables triac 28 and optoisolator 42 enables triac 36. Accordingly, power is connected from line 30 to motors 12 and 14. Cup 8 and auger 6 are driven and wood pellets are deposited in firepot 16. Timer 39 remains activated for a predetermined time, typically about 12 minutes, which is selected so there is a high probability that the fire burning in firepot 16 will become sufficiently hot to ignite wood pellets. In this fashion, a pilot fire is ignited from the kindling fire previously started in firepot 16. After the predetermined time, timer 39 times out and triac 28 is rendered non-conductive. Low limit switch 26 becomes conductive when the pilot fire is burning and connects power to motors 12 and 14 when triac 36 is conductive. If the kindling fire is extinguished before a pilot fire has been lit, switch 26 never becomes conductive and motors 12 and 14 stop when timer 39 times out.

To shut off the furnace at the end of the heating season, the supply of wood pellets in storage hopper 2 is allowed to run out. The fire in firepot 16 burns out and the temperature in the firebox falls, causing low limit switch 26 to become non-conductive. When low limit switch 26 becomes non-conductive, motors 12 and 14 are disabled even if switch 32 becomes conductive.

The circuit described with reference to FIG. 2 therefore allows a pellet furnace to be started by supplying enough wood pellets to the firebox to ignite a pilot fire. As long as a fire is burning in the firebox, the control circuit automatically supplies wood pellets to the furnace at a sufficient rate to sustain the pilot fire. The possibility of fuel overflow in the firebox is avoided by stopping the flow of fuel after a predetermined time when the pilot fire is not successfully ignited.

The circuit described with reference to FIG. 2 makes it somewhat easier to start a pilot fire at the beginning of the heating season, but it is still inconvenient to have to light a kindling fire in order to start the pilot fire. An ignition system employing a gas flame may be more convenient for lighting a pilot fire but may be unsafe since a gas supply, such as propane, has to be placed next to the furnace. Similar problems apply to an ignition system using liquid fuel.

It is known to use an electrical resistance heating element to supply ignition heat for solid fuel in a furnace. However, known systems are subject to disadvantage because the temperature required to ignite a solid fuel is generally considerably lower than the temperature that exists in a furnace when the fuel is burning strongly, and the constant exposure to high temperatures reduces the useful operating life of the heating element.

Figure 1A:
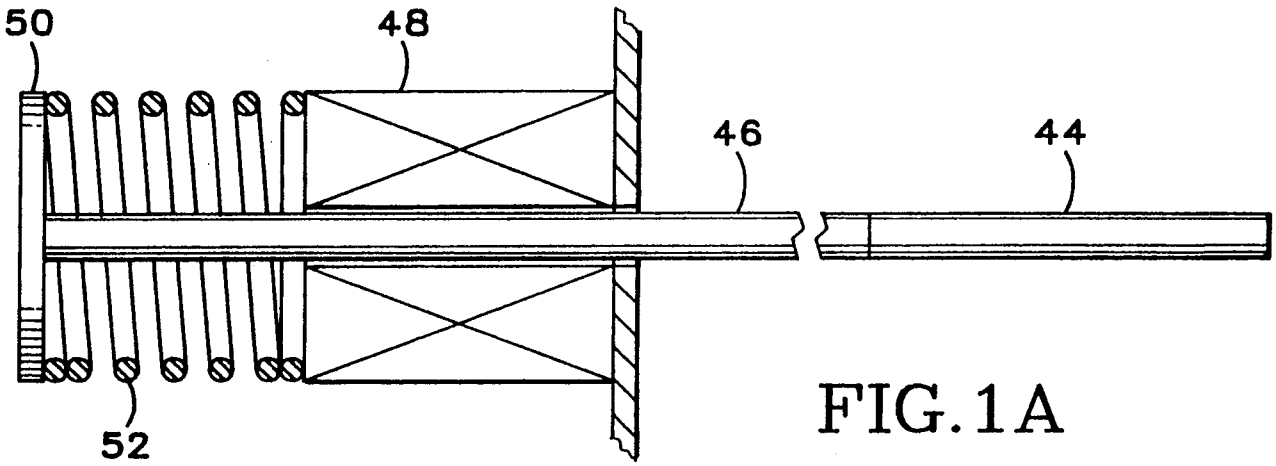
FIG. 1A is a diagram of a displaceable heating element.
Figure 3:
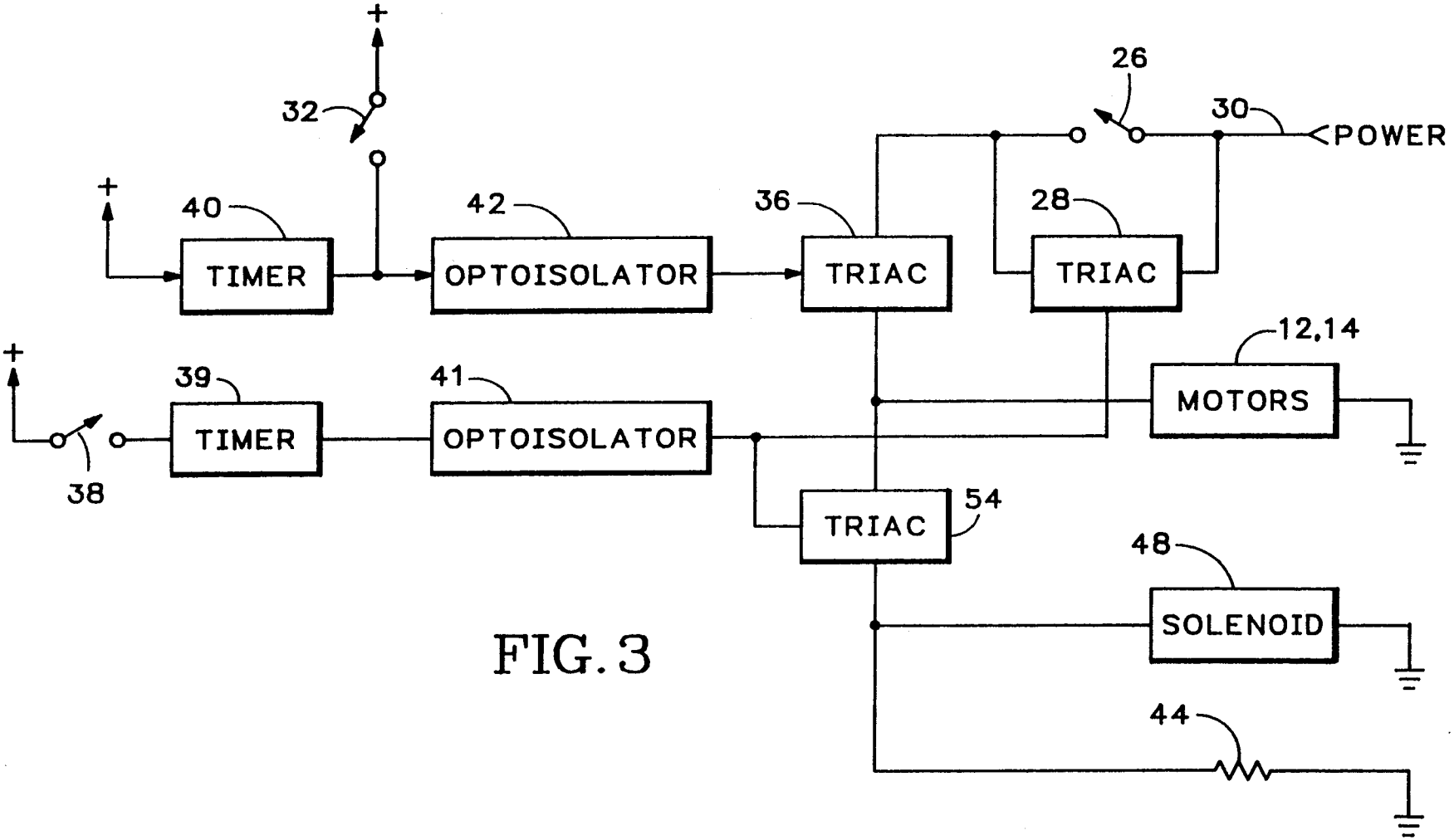
FIG. 3 is a circuit diagram for an electrical control system that automatically starts a pellet furnace pilot fire.

FIG. 3 illustrates a modification of the circuit described with reference to FIG. 2. The circuit shown in FIG. 3 is used in conjunction with modifications to the furnace as described with reference to the FIG. 2 circuit. These modifications are shown in phantom in FIG. 1 and are also shown in FIG. 1A. Specifically, FIG. 1A illustrates an electrical resistance heating element 44 that is mounted on the end of an iron rod 46, which extends through the wall of the firebox and the wall of the plenum. Rod 46, with heating element 44 mounted thereon, is displaceable relative to firebox 10 between an inserted position, in which heating element 44 extends at least partially into the firepot, and a retracted position, in which heating element 44 is outside the firepot. Rod 46 passes through an annular solenoid 48, which is mounted on the wall of the plenum, and carries a stop plate 50 at its outer end. A compression spring 52 is mounted on rod 46 between solenoid 48 and plate 50. When solenoid 48 is de-energized, the force of spring 52 pushes against stop plate 50 and displaces heating element 44 towards its retracted position. If solenoid 48 is energized, the electromagnetic force generated by solenoid 48 overcomes the force of spring 52 and moves heating element 44 to its inserted position. Referring to FIG. 3, heating element 44 and solenoid 48 are connected to triac 36 through a triac 54.

When the furnace is off at the beginning of the heating season, low limit switch 26 is non-conductive. No power is supplied to motors 12, 14, heating element 44 or solenoid 48. Since solenoid 48 is not energized, heating element 44 is in its retracted position.

To start the pilot fire, the room thermostat is set so that it demands heat and accordingly switch 32 is conductive. Switch 38 is depressed, activating timer 39. Optoisolator 41 enables triacs 28 and 54 and optoisolator 42 enables triac 36. Power is supplied from line 30 through triacs 28 and 36 to motors 12, 14, which drive auger 6 and cup 8 to feed wood pellets into the firebox. Triacs 28, 36 and 54 connect power from line 30 to solenoid 48, which displaces heating element 44 to its inserted position, and to heating element 44, which heats up. Timer 39 remains on for a sufficient amount of time for there to be a high degree of probability that heating element 44 has reached a temperature sufficient to ignite the wood pellets that have been fed into firebox 10 by auger 6. Timer 39 then times out, disabling triacs 28 and 54. Solenoid 48 becomes de-energized, allowing the spring 52 to move heating element 44 to its retracted position. Further, power is disconnected from the heating element. As explained with reference to FIG. 1, motors 12, 14 continue to operate whenever triac 36 is conductive until the temperature in the firebox goes below the temperature setting of low limit switch 26. However, triac 54 prevents switch 26 and triac 36 from connecting power from line 30 to heating element 44 or solenoid 48 while timer 39 is inactive.

The control circuit shown in FIG. 3 therefore automatically starts a pilot fire by energizing a heating element that ignites fuel that has been supplied to the firebox. The pilot fire is maintained by low limit switch 26 allowing auger 6 and cup 8 to supply wood pellets to the firebox under the control of timer 40. The control circuit in FIG. 3 also helps maintain heating element life by reducing extended exposure to extreme heat.

Although the system described with reference to FIG. 3 has certain advantages, it does not address a fundamental problem underlying the use of a pilot fire, which is that fuel ignition using a pilot fire is not energy efficient since there is a continuous burning of fuel even when there is no demand for heat from the furnace.

Figure 4:
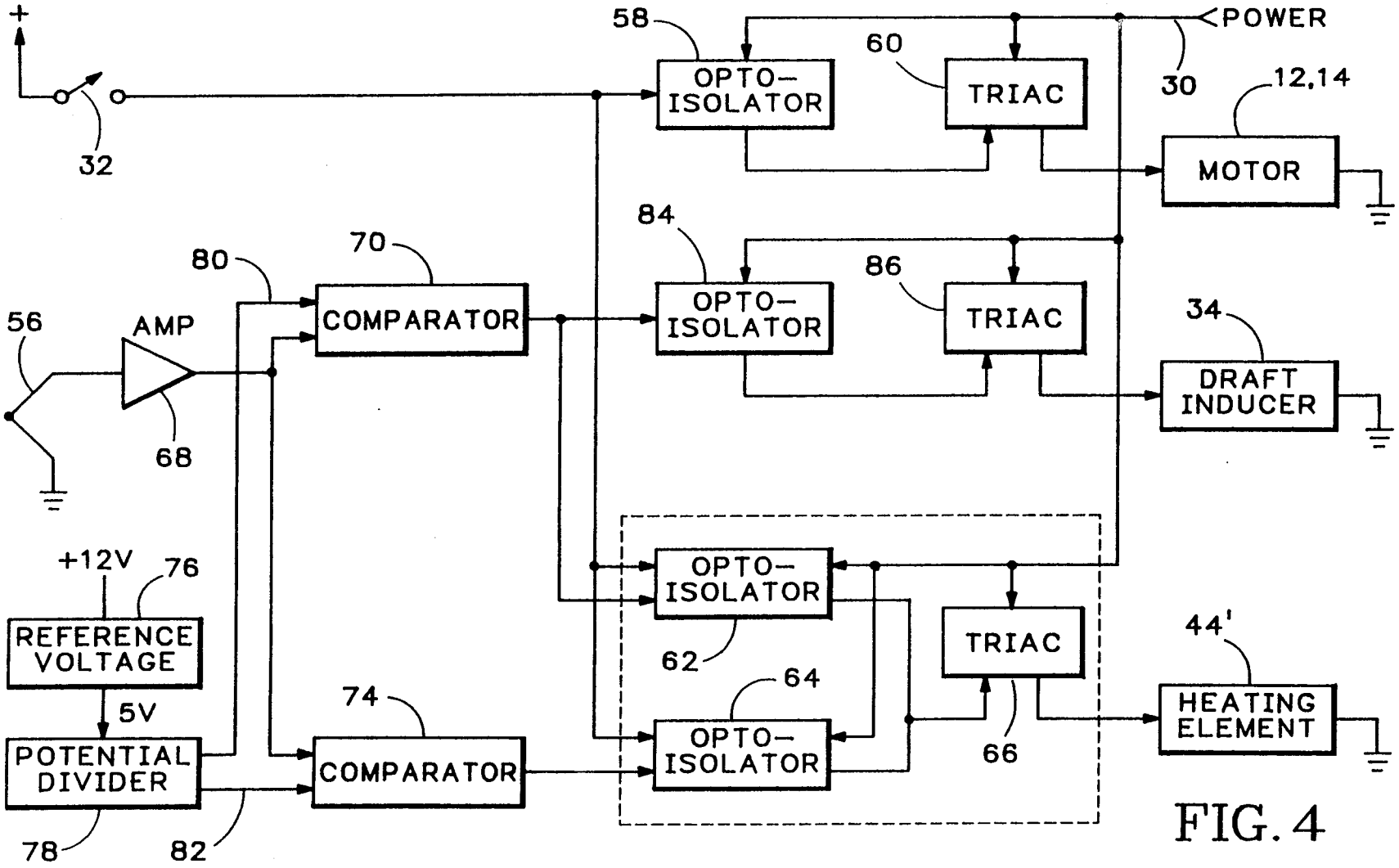
FIG. 4 is a circuit diagram for an electrical control system that uses a heating element for wood pellet ignition.

FIG. 4 illustrates another modification of the circuit described with reference to FIG. 2, which does not require a pilot fire for ignition of wood pellets. FIG. 4 illustrates the control circuit for an on demand wood pellet furnace that uses a heating element to ignite wood pellets each time heat is required. Referring to the phantom lines in FIG. 1, solenoid 48 and spring 52 are omitted, and heating element 44' is mounted stationarily inside firebox 10. Referring again to FIG. 4, a thermocouple 56 is embedded inside heating element 44' and is used to measure the temperature of the heating element. The room thermostat switch 32 is coupled through an optoisolator 58 to a triac 60. When switch 32 is conductive and triac 60 is enabled, power from line 30 is supplied to motors 12 and 14. Thermostat switch 32 is also connected to optoisolators 62 and 64, which control the state of a second triac 66 for connecting power from line 30 to heating element 44'.

Thermocouple 56 is connected to an amplifier 68, which generates a temperature signal whose voltage depends on the temperature of thermocouple 56. The temperature signal is supplied to comparators 70 and 74. A reference voltage source 76 provides a stable voltage supply to a potential divider 78 which generates predetermined voltage levels on lines 80 and 82. The voltage level on line 80, which is connected to comparator 70, is selected to equal the voltage output of amplifier 68 when thermocouple 56 reaches a first predetermined threshold temperature. When the voltage of the temperature signal is below the voltage on line 80, the output terminal of comparator 70 is at ground. When the voltage of the temperature signal reaches the voltage level on line 80, comparator 70 provides a positive voltage output. The output of comparator 70 is applied to an optoisolator 84 for enabling a triac 86 and is also applied to optoisolator 62. Amplifier 68 also supplies the temperature signal to comparator 74, which also receives a voltage representing a second predetermined threshold temperature on line 82. When the temperature signal reaches the voltage on line 82, comparator 74 applies a positive voltage to optoisolator 64. Otherwise, the output terminal of comparator 74 is at ground.

Figure 4A:
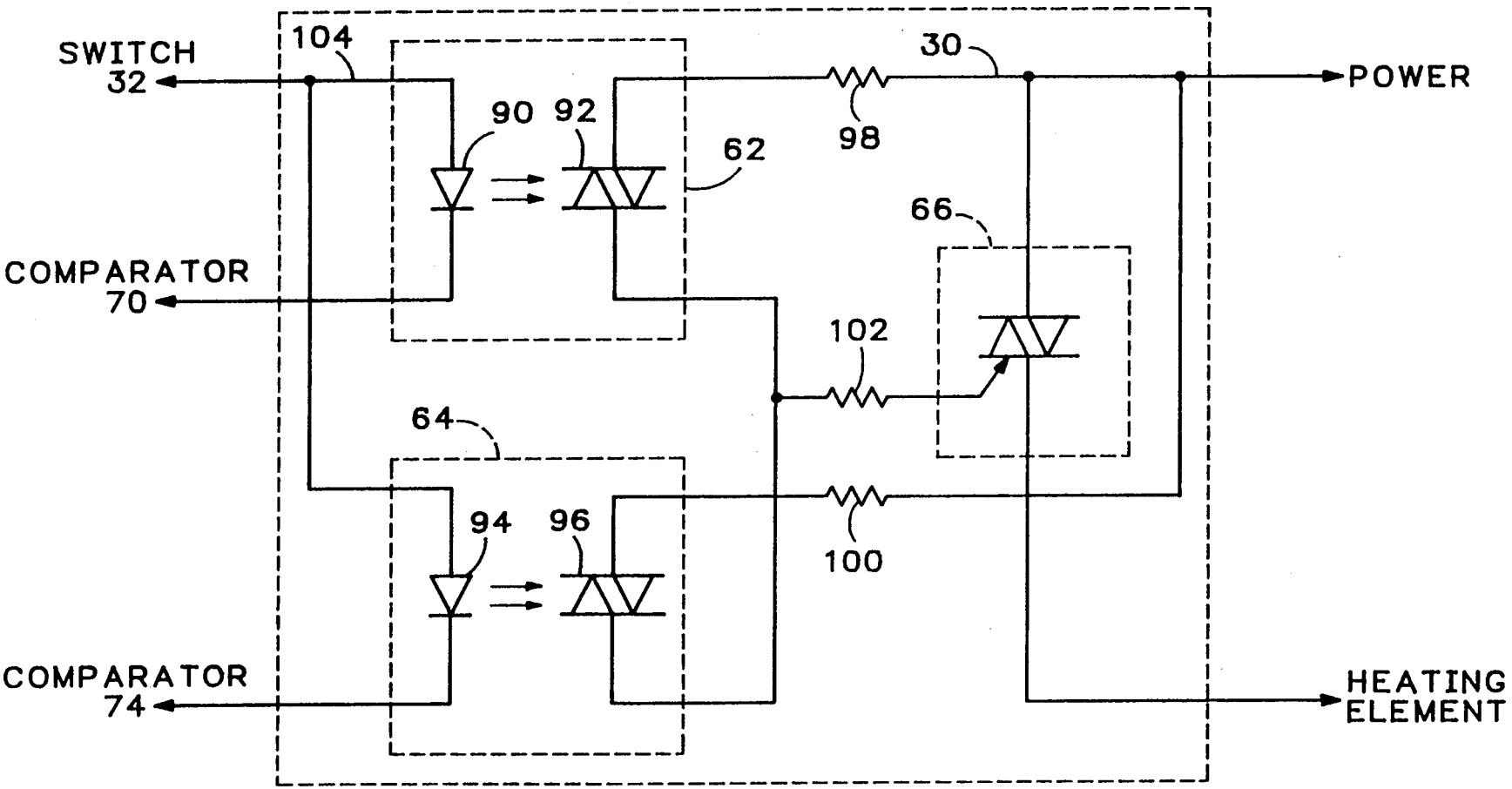
FIG. 4A is a circuit diagram for the regulatable power supply in FIG. 4.

FIG. 4A illustrates in more detail how optoisolator 62 and optoisolator 64 are coupled to triac 66. Optoisolator 62 consists of an infrared-emitting diode 90 optically coupled to a phototriac 92 while optoisolator 64 consists of an infrared-emitting diode 94 optically coupled to a phototriac 96. Phototriacs 92 and 96 have respective terminals connected to line 30 through resistors 98 and 100 respectively. The opposite terminals of phototriacs 92 and 96 are connected together and are connected to the control electrode of triac 66 through a resistor 102. When the thermostat switch 32 is non-conductive, phototriacs 92 and 96 are disabled and triac 66 is non-conductive. However, when the thermostat switch is conductive, so line 104 is at a positive voltage, and the outputs of comparators 70 and 74 are both at ground, both infrared-emitting diode 90 and infrared-emitting diode 94 are forward biased causing phototriac 92 and phototriac 96 to become conductive. This serves to minimize the resistance between line 30 and the control electrode of triac 66 allowing triac 66 to become enabled at a high duty cycle and supply a high RMS current from line 30 to heating element 44'. If comparator 70 then provides a positive output voltage, because the temperature signal reaches the voltage on line 80, the voltage across infrared-emitting diode 90 becomes small enough to disable phototriac 92. This increases the resistance between line 30 and the control electrode of triac 66 reducing the duty cycle of triac 66 and the RMS current supplied to heating element 44'. If comparator 74 then provides a positive output voltage, phototriac 96 also is disabled causing triac 66 to become non-conductive so that heating element 44' is disconnected from line 30.

Referring back to FIG. 4, when the temperature sensed by the room thermostat is above the level selected on the room thermostat, switch 32 is non-conductive and triacs 60 and 66 are disabled, disconnecting power from motors 12, 14 and heating element 44'. If the furnace has been off for some time, so that the temperature sensed by thermocouple 56 is below the temperature required to enable triac 86, power is also disconnected from draft inducer 34.

When the temperature in the room goes below the room thermostat setting, thermostat switch 32 becomes conductive, enabling triac 60 to connect power to motors 12, 14 so that wood pellets are fed into the firebox. Thermostat switch 32 also enables triac 66 to connect full power from line 30 to heating element 44', causing the temperature of heating element 44' to increase rapidly. When thermocouple 56 reaches the first predetermined threshold temperature, which is sufficient to ignite wood pellets and may be about 320° C., optoisolator 62 is disabled, reducing the amount of power triac 66 is able to supply to heating element 44' and slowing the rate at which the temperature of heating element 44' increases. However, heating element 44' continues to be energized in order to ensure that the wood pellets delivered to the firebox are ignited. For example, if some of the wood pellets are wet, it may take longer for these pellets to start burning. Furthermore, at the first threshold temperature, triac 86 connects power from line 30 to draft inducer 34 in order to supply air to support combustion of wood pellets. The draft inducer is not energized until the heating element reaches ignition temperature because oxygen is not earlier required to support combustion, and supply of air at a lower temperature removes heat from the firebox, increasing the time taken to bring the wood pellets to ignition temperature. When heating element 44' reaches the second temperature level, which is typically about 430° C. and is such that there is high degree of confidence of wood pellet ignition, optoisolator 64 is disabled and triac 66 disconnects heating element 44' from line 30. Draft inducer 34 and motors 12, 14 continue to operate until thermostat switch 32 becomes non-conductive.

When the temperature in the room goes above the setting on the room thermostat, thermostat switch 32 becomes non-conductive, shutting off power to motors 12, 14. The fire in the furnace continues to burn until the fuel in firebox 10 has been consumed. Draft inducer 34 remains on until the fire in the furnace burns out. Keeping the draft inducer on until the fire is extinguished serves to blow ashes away from the heating element, which facilitates lighting the fire next time the room thermostat demands heat.

It will be appreciated that the present invention is not restricted to the particular embodiment that has been described and illustrated, and that variations may be made therein without departing from the scope of the invention as defined in the appended claims and equivalents thereof. For example, in order to prolong the life of heating element 44' in FIG. 4, heating element 44' may be arranged to be displaceable as described with reference to FIG. 2. In this case, thermocouple 56 is replaced with a temperature measurement device permanently located inside the firebox. The temperature measurement device is positioned to accurately measure the temperature in the vicinity of the heating element when it is in its inserted position inside the firebox. The temperature measurement device operates in the same manner as thermocouple 56 controlling the draft inducer and heating element relative to temperature level in firebox 10.

I claim:

1. Apparatus for igniting fuel in a solid fuel furnace having a firebox and electrically controllable fuel supply means for feeding fuel to the firebox, said apparatus comprising:

an electrically controllable heating element for igniting fuel in the firebox, means adapted to be connected to the fuel supply means and the heating element for energizing both the fuel supply means and the heating element, whereby both the fuel supply means and the heating element are energized throughout a predetermined activation time, and means for supplying power to the fuel supply means after said activation time has expired.

2. Apparatus according to claim 1, wherein the means for supplying power to the fuel supply means after said activation time has expired comprise a low limit temperature switch, a second switch connected in series with the low limit temperature switch, and thermostat means for controlling the state of the second switch.

3. Apparatus according to claim 2, wherein the thermostat means comprise a timer and a thermostat switch that overrides the timer, the second switch being conductive when the thermostat means demand heat and being intermittently conductive when the thermostat means do not demand heat.

4. Apparatus according to claim 1, further comprising a switch for preventing supply of current to said heating element after said activation time has expired.

5. Apparatus according to claim 1, wherein the means for energizing said fuel supply means and said heating element comprise a triac for controlling power to the fuel supply means and the heating element, and a circuit for enabling the triac.

6. Apparatus according to claim 5, wherein the circuit for enabling the triac includes a manually operable switch.

7. Apparatus for igniting fuel in a solid fuel furnace having a firebox and electrically controllable fuel supply means for feeding fuel to the firebox, said apparatus comprising:

an electrically controllable heating element for igniting fuel in the firebox, the heating element being displaceable between a position inside the firebox and a position outside the firebox, means for displacing the heating element from its position outside the firebox to its position inside the firebox, means for activating the displacing means, the heating element and the fuel supply means for a predetermined activation time, and means for supplying power to the fuel supply means after said activation time has expired.

8. Apparatus according to claim 7, wherein the means for activating the displacing means, the heating element and the fuel supply means comprise a triac for controlling power to the fuel supply means, the heating element, and the means for displacing the heating element, and a circuit for enabling the triac.

9. Apparatus according to claim 7, wherein the means for displacing the heating element from its position outside the firebox to its position inside the firebox comprise an electrically activated solenoid.

10. Apparatus according to claim 9, wherein the means for supplying power to the fuel supply means after said activation time has expired comprise a low limit temperature switch, a second time switch connected in series with the low limit temperature switch, and thermostat means for controlling the state of the second switch.

11. Apparatus according to claim 10, wherein the thermostat means comprise a timer and a thermostat switch that overrides the timer, the second switch being conductive when the thermostat means demand heat and being intermittently conductive when the thermostat means do not demand heat.

12. Apparatus according to claim 10, comprising a switch for preventing supply of current to the solenoid and the heating element after said activation time has expired.

13. Apparatus for igniting fuel in a solid fuel furnace having a firebox, said apparatus comprising:

an electrical resistance heating element positioned for igniting fuel in the firebox, regulatable power supply means for energizing said heating element, a temperature sensor for sensing temperature in the firebox, and means for controlling said power supply means in accordance with the temperature sensed by the temperature sensor, whereby said power supply means energize said heating element at a first, second or third power level depending on the temperature sensed by the temperature sensor.

14. Apparatus according to claim 13, wherein the regulatable power supply means comprise a triac for controlling power to the heating element, and the means for controlling said power supply means comprise a circuit for controlling the amount of power said triac connects to said heating element.

15. Apparatus according to claim 13, wherein the means for controlling said power supply means comprise at least one voltage comparator responsive to a temperature signal produced by the temperature sensor.

16. Apparatus according to claim 13, further comprising:

electrically controllable draft inducer means for aiding combustion of fuel in the firebox, and means for activating said draft inducer means in accordance with the temperature sensed by the temperature sensor.

17. Apparatus according to claim 16, wherein the means for activating said draft inducer means comprise at least one voltage comparator responsive to a temperature signal produced by the temperature sensor.

18. Apparatus according to claim 16, wherein the means for activating said draft inducer means comprise a triac for controlling the connection of power to the draft inducer means, and a circuit for enabling said triac.

19. Apparatus according to claim 18, wherein the regulatable power supply means comprise a second triac for connecting power to the heating element, and a circuit for controlling the amount of power said second triac connects to said heating element.

20. Apparatus according to claim 13, further comprising means for activating the heating element in dependence on temperature existing outside the furnace.

21. Apparatus according to claim 20, wherein the means for activating said heating element comprise a room thermostat switch.

22. Apparatus for igniting fuel in a solid fuel furnace having a firebox, said apparatus comprising:

an electrically controllable heating element for igniting fuel in the firebox, regulatable power supply means for energizing said heating element, a temperature sensor for sensing temperature in the firebox, electrically controllable draft inducer means for aiding combustion of fuel in the firebox, and control means for both controlling said power supply means and activating said draft inducer means in accordance with the temperature sensed by the temperature sensor.

23. Apparatus according to claim 22, wherein the control means comprise at least one voltage comparator responsive to a temperature signal produced by the temperature sensor.

24. Apparatus according to claim 22, wherein the control means comprise a triac for controlling the connection of power to the draft inducer means, and a circuit for enabling said triac.

25. Apparatus according to claim 22, wherein the regulatable power supply means comprise a triac for connecting power to the heating element, and a circuit for controlling the amount of power said triac connects to said heating element.

26. Apparatus according to claim 22, comprising means for providing a first signal when the temperature sensed by the temperature sensor reaches a first threshold value and for providing a second signal when the temperature sensed by the temperature sensor reaches a second threshold value, and wherein the control means activate the draft inducer means in response to the first signal and de-energize the heating element in response to the second signal.

* * * * *